US006644372B2

(12) United States Patent
Judkins

(10) Patent No.: US 6,644,372 B2
(45) Date of Patent: Nov. 11, 2003

(54) CORDLESS BLIND

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 09/815,403

(22) Filed: Mar. 22, 2001

(65) Prior Publication Data

US 2002/0157796 A1 Oct. 31, 2002

(51) Int. Cl.[7] ..... A47H 5/00
(52) U.S. Cl. ..... 160/84.04; 160/170
(58) Field of Search ..... 160/84.02, 170 R, 160/171 R, 168.1 R, 191, 192, 84.04, 84.05; 185/37, 45; 242/373, 375.1, 375.3, 375.5, 378.1

(56) References Cited

U.S. PATENT DOCUMENTS

| | | | | |
|---|---|---|---|---|
| 13,251 | A | | 7/1855 | Bixler |
| 322,732 | A | | 7/1885 | Lang |
| 1,951,659 | A | | 3/1934 | Kesner |
| 2,317,659 | A | * | 4/1943 | Williams |
| 2,420,301 | A | | 5/1947 | Cusumano |
| 3,249,148 | A | | 5/1966 | Zablodil et al. |
| 3,487,875 | A | | 1/1970 | Shukat et al. |
| 4,623,012 | A | | 11/1986 | Rude et al. |
| 4,676,292 | A | * | 6/1987 | Valle et al. |
| 5,105,867 | A | | 4/1992 | Coslett |
| 5,133,399 | A | | 7/1992 | Hiller et al. |
| 5,285,838 | A | * | 2/1994 | Rapp et al. |
| 5,476,132 | A | | 12/1995 | Jacobson |
| 5,482,100 | A | | 1/1996 | Kuhar |
| 5,531,257 | A | | 7/1996 | Kuhar |
| 5,680,891 | A | * | 10/1997 | Prince |
| 5,706,876 | A | | 1/1998 | Lysyj |
| 5,778,956 | A | * | 7/1998 | Judkins |
| 5,813,447 | A | | 9/1998 | Lysyj |
| 5,906,232 | A | | 5/1999 | Bauer et al. |
| 5,960,846 | A | | 10/1999 | Lysyj |
| 6,003,584 | A | | 12/1999 | Weinreich |
| 6,024,154 | A | * | 2/2000 | Wang et al. |
| 6,029,734 | A | * | 2/2000 | Wang et al. |
| 6,056,036 | A | | 5/2000 | Todd et al. |
| 6,079,471 | A | | 6/2000 | Kuhar |
| 6,135,189 | A | * | 10/2000 | Weinreich |
| 2002/0088562 | A1 | * | 7/2002 | Palmer ..... 160/170 |

* cited by examiner

*Primary Examiner*—Blair M. Johnson
(74) *Attorney, Agent, or Firm*—Buchanan Ingersoll, P.C.

(57) ABSTRACT

A cordless blind contains one or more springs in the bottomrail of the blind. Preferably the spring is a constant force spring motor and is connected to at least one cord collector in a manner to maintain tension on the cord collector. The tension causes the lift cords to be collected on the cord collector when the cord collector and the lift cords are free to move, thereby moving the bottomrail toward the headrail. Preferably, a lock mechanism is attached to the cord collector or the lift cords. The lock mechanism has a locked position wherein the lift cords are restrained from being collected on the cord collector and has an unlocked position that allows the lift cords and cord collector to move.

9 Claims, 6 Drawing Sheets

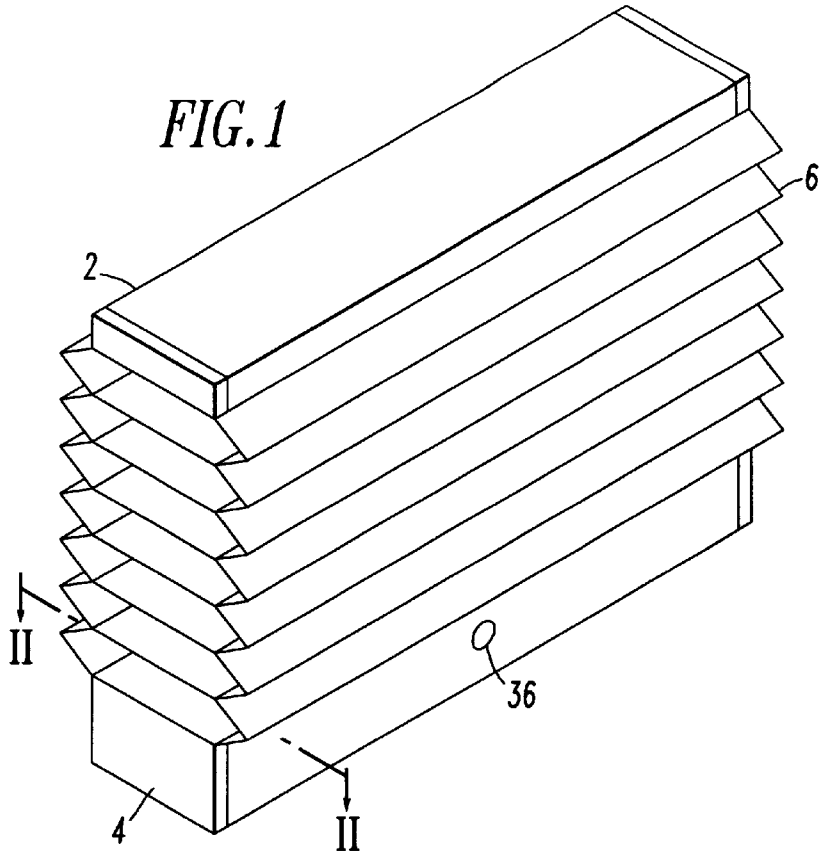
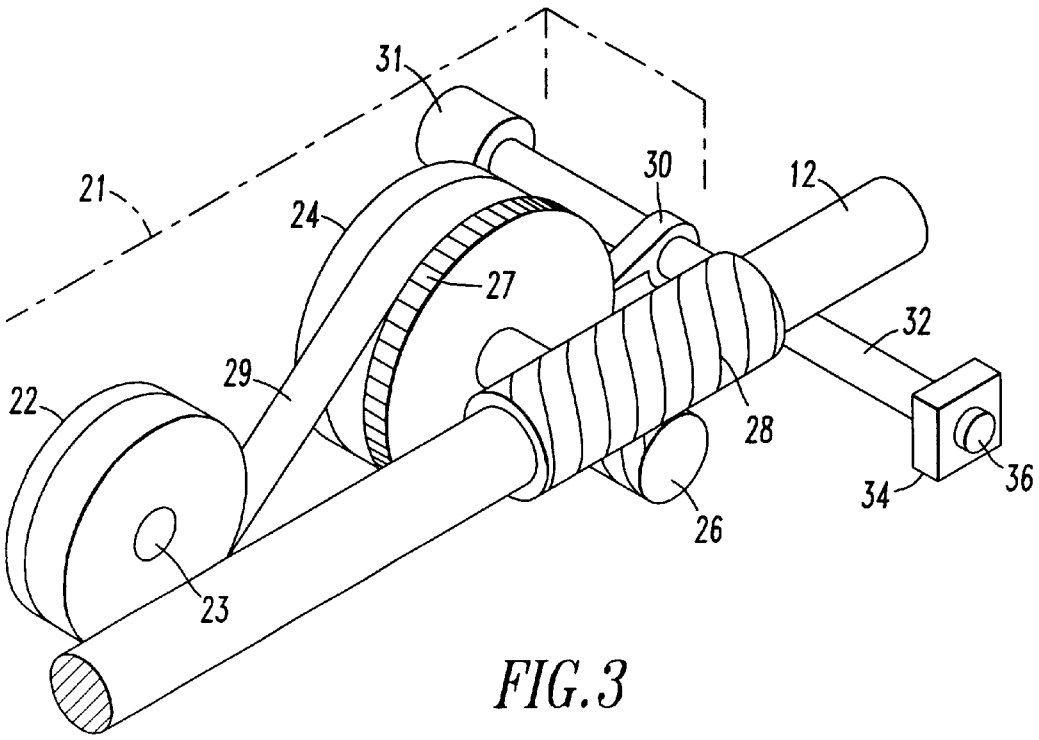
FIG. 3

CORDLESS BLIND

FIELD OF INVENTION

The invention relates to lift systems for raising and lowering window blinds that have lift cords such as pleated shades, roman shades and venetian blinds.

BACKGROUND OF THE INVENTION

Venetian type blinds have a series of slats hung on ladders that extend from a headrail to a bottomrail. In most venetian blinds a pair of lift cords is provided each having one end attached to the bottomrail and then passing through elongated holes in the slats up to and through the headrail. When the lift cords are pulled downward the blind is raised and when the lift cords are released the blind is lowered. A cord lock is usually provided in the headrail through which the lift cords pass. The cord lock allows the user to maintain the blind in any desired position from fully raised to fully lowered. Pleated shades and roman shades are also raised and lowered by lift cords running from the bottom of the shade into a headrail. The cord lock system and other cord lift systems used in venetian blinds can also be used in pleated shades and roman shades. Another type of lift system for window blinds utilizes a take-up tube for each lift cord. These tubes are contained on a common shaft within the headrail. Each lift cord is attached to one end of a tube. The tubes are rotated to wind or unwind the lift cord around tubes. This system is generally known as a tube lift system. Some tube lift systems are operated by a continuous loop cord that passes over one end of the axle and extends from the headrail.

In recent years the art has been concerned that cords, particularly looped cords, pose a strangulation threat to children who may become entangled in the cords. Consequently, there has been much interest in cordless blinds. These blinds rely on electric motors or spring motors to raise and lower the lift cord. One common cordless blind simply contains a motor connected to a tube collection system within the headrail. Another cordless blind relies upon a constant force spring motor attached to a spool or spools on which the lift cords are collected. This type of cordless blind is disclosed by Coslett in U.S. Pat. No. 5,105,867 and by Kuhar in U.S. Pat. Nos. 5,482,100; 5,531,257 and 6,079,471.

Coslett discloses a sun shade having a series of blades connected together to form a serrated shape like a pleated shade. The upper blade is mounted within a hollow housing and the lower blade is secured to a plate member. A constant force spring plate is wound around a spring spool member and further engaged to an output spool, both of which are within a hollow handle secured to the hollow housing. A cord is connected to the output spool and passed from the handle through the housing and the blades and is connected to the plate member. Such a cording arrangement is similar to that of a lift cord in a pleated shade or venetian blind. The spring retains the blades in a folded closed position. When the shade is extended the spring exerts tension on the cord. Consequently, Coslett teaches the user to fix the plate member along one side of the window and to provide a hook to retain the hollow housing at the opposite side of the window when the shade is covering the window. Thus, Coslett's shade can be in only one of two positions, fully extended to cover the window or fully retracted. Furthermore, Coslett's blind is not suitable for installation in an orientation in which one rail is fixed at the top of the window frame as is done for most building windows. That is so because when the blind is fully retracted most people could not reach the handle to extend or close the blind without standing on a stool or ladder.

Kuhar discloses a cordless, balanced blind that contains at least one constant variable force spring motor in the headrail. The springs in these motors vary in thickness or in width along their length as they are wound around storage drums. A cord spool is coupled to one or more spring drums. The lift cords of the blind are wound about the spool. Thus, the spring winds or unwinds as the blind is raised or lowered. The difference in width or thickness of the spring compensates for the increasing weight of the blind on the cords as the window covering is raised and the decreasing weight as the blind is lowered. Kuhar teaches that much effort be made to select and couple the spring motor to the cords so that the bottomrail is balanced at any and every position. Kuhar further teaches that several spring motors may be coupled together.

Placing the spring motors in the headrail as taught by Kuhar requires that the headrail be tall enough and wide enough to accommodate the spring motors. Consequently, the headrail must be larger than would be required if no spring motors were in the headrail. If one placed the spring motors in the bottomrail, a smaller headrail could be used; however, the weight of the bottomrail would be increased. Increasing the weight of the bottomrail would make it much more expensive to balance the bottomrail in any and every position as Kuhar teaches is critical. Perhaps this could be accomplished with more or larger spring motors, but that would change the dynamics of the blind. For that reason one following the teachings of Kuhar would be lead away from putting spring motors in the bottomrail.

SUMMARY OF THE INVENTION

I provide a cordless blind containing one or more springs in the bottomrail of the blind. Preferably the spring is a constant force spring motor of the type disclosed by Coslett and Kuhar. The spring motor is connected to at least one cord collector in a manner to maintain tension on the cord collector. The tension causes the lift cords to be collected on the cord collector when the cord collector and the lift cords are free to move, thereby moving the bottomrail toward the headrail. I further provide a lock mechanism attached to the cord collector or the lift cords. The lock mechanism has a locked position wherein the lift cords are restrained from being collected on the cord collector and has an unlocked position that allows the cord collector and plurality of lift cords to move freely. I prefer that the lock mechanism be biased toward a locked position. However, a two position, i.e. locked or unlocked, lock mechanism could be used. I further prefer to provide a button on the bottomrail to operate the lock mechanism.

The cordless blind of the present invention is easy to operate. A user simply presses the button to release the lock and either pulls the bottomrail down or allows the spring motor to raise the bottomrail. When the button is released the lock engages if the lock is of the type that is biased to a locked position. If a two position lock is used the user presses the button, moves the bottomrail to a desired position and presses the button again to lock the lock mechanism. Because the lift cords and cord collector are no longer free to move, the bottomrail stays in the position where it was when the button was released.

This cordless blind could be a pleated shade, a cellular shade, a roman shade or a venetian blind. If the shade is a venetian blind I prefer to provide ladders in which the rails of the ladders are connected to form a continuous loop. Then the slats can be tilted with a conventional tilt mechanism in the headrail.

BRIEF DESCRIPTION OF THE FIGURES

FIG. 1 is a rear perspective view of a present preferred embodiment of my cordless blind.

FIG. 3 is an enlarged view of the spring motor in the embodiment shown in FIGS. 1 and 2.

DESCRIPTION OF THE PREFERRED EMBODIMENTS

Figure 2:
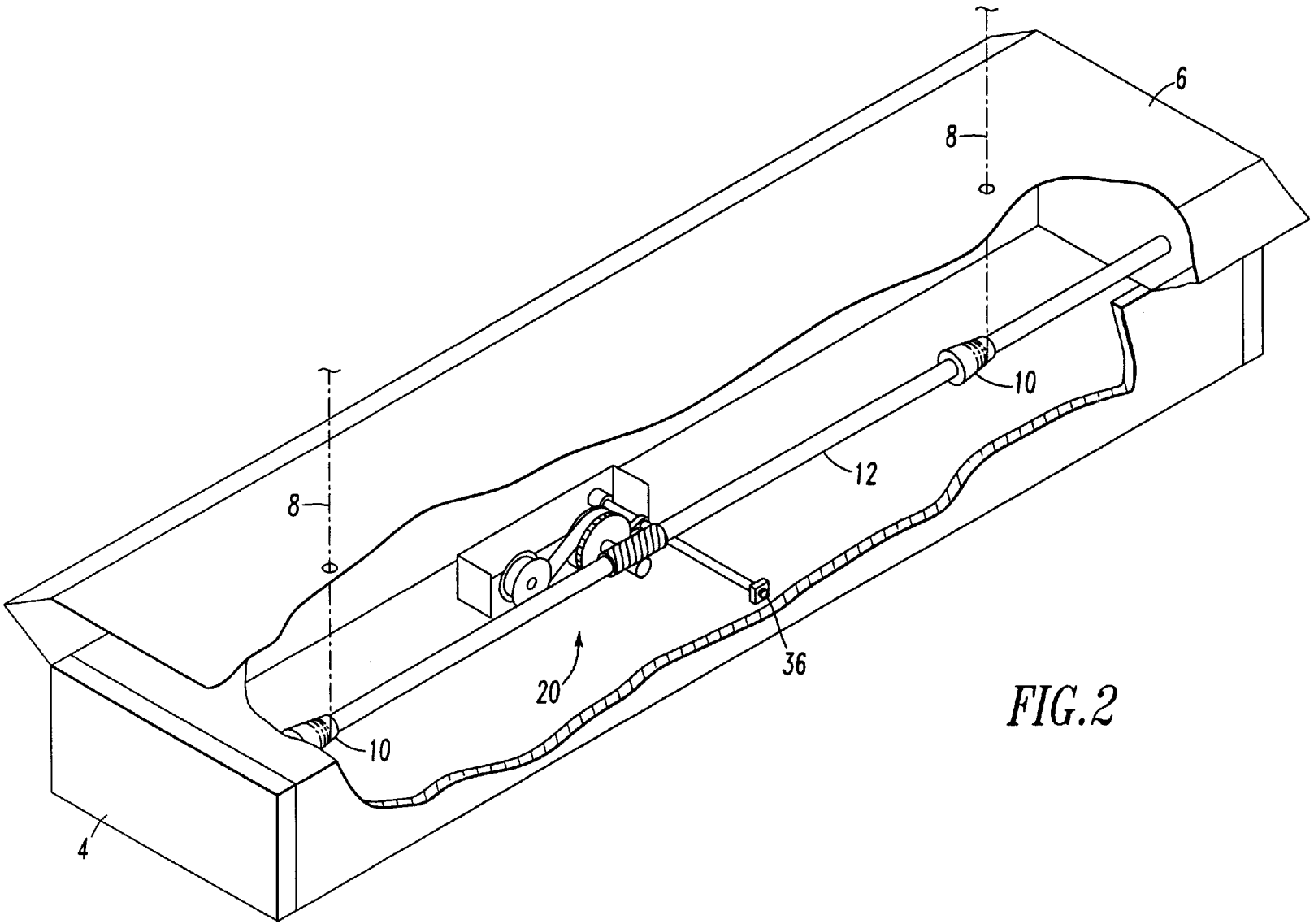
FIG. 2 is a sectional view taken along the line II—II of FIG. 1 wherein a portion of the front wall of the bottomrail has been cut away.

A present preferred embodiment of my cordless blind shown in FIG. 1 is comprised of a headrail 2, a bottomrail 4 and a window covering material such as cellular material 6 connected between the headrail and the bottomrail. The window covering material could also be a single panel of pleated material, roman shade material or a set of slats carried on ladders as in a venetian blind. The blind could be any width or length and likely would be larger than the blind shown in FIG. 1. Lift cords 8 are fixed within the headrail, pass through the window covering material and into the bottomrail. Although only two lift cords 8 are shown in FIG. 2 it should be understood that the cordless blind could have more lift cords with the number of lift cords being related to the width of the blind. The lift cords 8 are collected on cones 10 within the bottomrail The cones each have a central bore that enables them to be mounted on a common axle 12. The axle 12 is coupled to a spring motor 20 shown in detail in FIG. 3. If desired the cones could be omitted and the cords could be wrapped on the axle.

In a standard tube lift the lift cord is wound about a cylindrical tube or cylindrical axle. Consequently, each rotation of the axle will collect or release a length of cord equal to the circumference of the tube which can be calculated from the equation $L=\pi$ dn where d is the outside diameter of the tube plus the diameter of the cord and n is the number of revolutions. In blinds for standard residential and commercial windows the axle may rotate 40 or more times to fully raise or lower the blind. All window blinds that have lift cords will have at least two lift cords and each lift cord is wound on a separate tube. Although all tubes and cords are supposed to be the same diameter, one tube or cord often is larger than the diameter of another tube or cord with differences in diameters often being 0.005 inches and may be as much as 0.010 inches. Since the spool will rotate as many as eighty to over a hundred times to fully lower the blind, that means one lift cord will be lowered 0.4 inches more than the other lift cord. A difference of 0.25 inches is noticeable to a person looking at the blind or shade. Hence, if there is a difference in diameters in the cords or the axles the bottom of the shade will appear to be tilted. If the blind has more than two cords and the short cord is in the middle the bottomrail acts like a teeter-totter pivoting about the short middle cord and the whole blind oscillates as the blind is being raised or lowered.

In the lift system shown in FIG. 2 the total length of lift cord that will be released is determined by the equation:

$$L = \frac{\pi d_1 - d_2}{2}$$

Because a cone offers a series of different diameters a fabricator can position the cones on the axle so that the lift cords begin wrapping at different locations on the cones. Consequently, the fabricator can compensate for variations among cones and cords. The result is that every blind can be fabricated so that the bottom of the blind is level when the blind is fully lowered. The fabricator can adjust the position of the cord simply by rotating the cone relative to the axle.

Referring to FIGS. 2 and 3 the spring motor 20 has a bracket 21 on which a storage drum 22 and an output drum 24 are rotatably mounted in a spaced apart relationship. The storage drum is free to rotate about axle 23. When the output drum 24 rotates it turns axle 25 and attached worm gear 26. Output drum 24 has gear teeth or an attached gear 27 that engages pawl 30. When worm gear 26 turns, worm gear 28 on shaft 12 will also turn turning the shaft 12. A spring 29 is coupled between the storage drum 22 and the output drum 24. The spring provides a constant tension on the lift cords acting through the axles 23 and 12 and gears 26 and 28. The spring 29 may be configured in one of several ways to provide the desired tension. The first configuration has a constant thickness throughout the length of the spring. One end of the spring is narrower than the opposite end of the spring with the width gradually increasing or decreasing form one end to the other end. The narrow end is attached to the center of the storage drum 22 and the wider end attached to the center of the output drum. The spring is wound from one drum to the other in an opposite coil orientation. As the spring 29 is transferred from the storage drum 22 to the output drum 24, the width of the spring between the two drums will decrease and the spring will be wound oppositely to its original coil shape. Another embodiment of the spring varies in thickness from one end to the other end but has a constant width. The thinner end is attached at the core of the storage drum. The thicker end is attached to the core of the output drum. As in the first configuration, the orientation of the spring as it is transferred from the storage drum to the output drum is reversed. A third possible configuration is for the spring to vary in both width and thickness. Also, a laminated coil spring could be used.

A control shaft 32 extends from hub 31 to a control box 34. The control shaft carries a pawl 30 having teeth that will mesh with gear teeth 27 on drum 24. Control shaft 32 does not rotate but can move transversely along its centerline.

Consequently, when pawl 30 engages the gear teeth 27 on drum 24, the drum as well as the spring motor and the lift cords will not move. Button 36 controls movement of control shaft 32. In one configuration a spring is provided within hub 31 or control box 34 that biases the shaft to a locked position in which the pawl 30 engages the teeth 27 on drum 24. Consequently, the drum, spring motor and lift cord will not move until and unless button 36 is pressed. To operate the blind a user simply presses the button to release the lock mechanism and either pulls the headrail down or allows the spring motor to raise the bottomrail. While the lock is in this unlocked position the spring motor will cause axle 12 to turn collecting the lift cords on the cones. This force is such that a person can easily overcome the spring motors by pulling down on the bottomrail. The downward force will cause the axle 12 to rotate in an opposite direction playing out the lift cords and winding the spring in the spring motors in an opposite direction. When the button is released the lock engages. Because the lift cords and cord collector are no longer free to move, the bottomrail stays in the position where it was when the button was released. An alternative is to provide a two position button such that pushing the button once will cause the pawl to move away from the teeth on drum 24. The pawl will stay in that unlocked position until the button is pressed again. The second push of the button moves shaft 32 returning the pawl 30 to the locked position in engagement with teeth 27 on drum 24.

Figure 4:
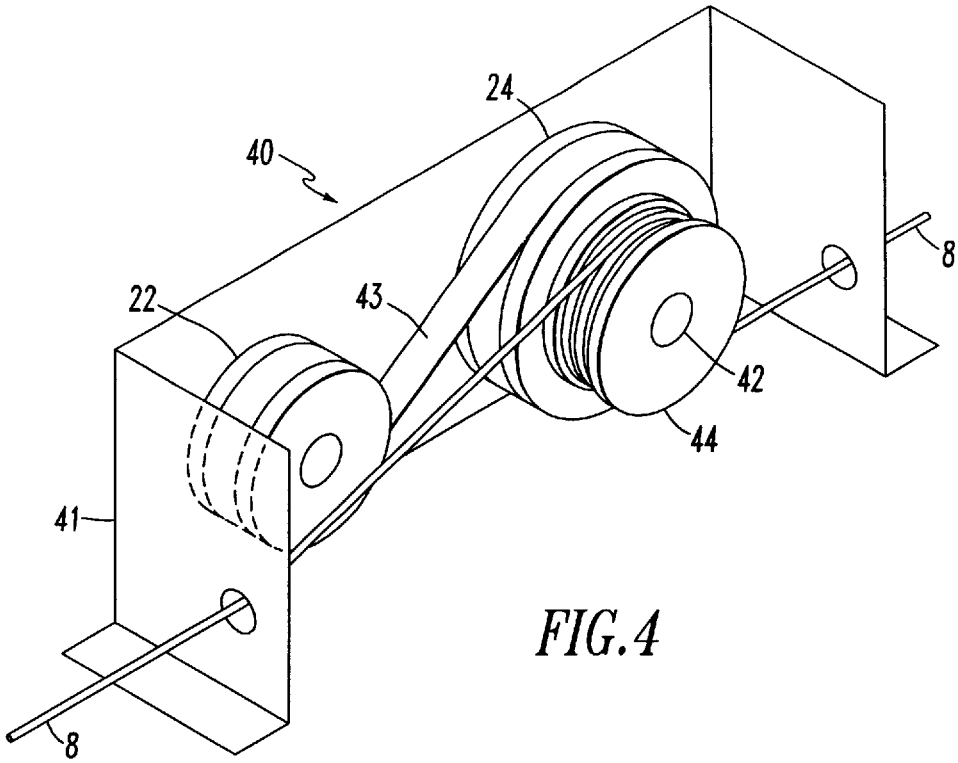
FIG. 4 is a perspective view similar to FIG. 3 of an alternative spring motor that can be used in the cordless blind of the present invention.

Several other configurations of spring motors can be used. The spring motor 40 of FIG. 4 has a storage drum 22 and a take up drum 24 carried on a bracket 41 with a spring 43 connected between them. This spring can be any of the springs described as suitable for use in the first embodiment and operates in the same manner. In this embodiment the lift cords 8 are collected on a spool 44 carried on a common axle 42 with the take up drum 24. Consequently, the take up drum 24 and the spool 44 will turn together in the same direction. As in the first embodiment there is a lock mechanism (not shown) that is connected to the take up drum through a gear mechanism or other suitable means.

Figure 5:
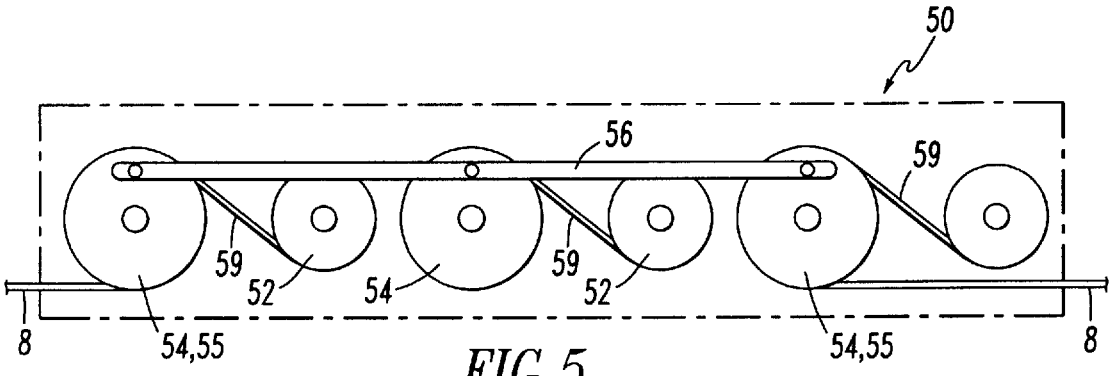
FIG. 5 is a front view of three interconnected spring motors that can be used in the cordless blind of the present invention.

Another spring motor configuration is illustrated in FIG. 5. This spring motor 50 has three take-up drums 52 each carrying a spring that is also connected to an associated storage drum 54. A link 56 connects the take up drums together. The lift cords are wound on spools connected to a respective storage drum. This spool and take up drum configuration is similar to the spool 42 and take up drum 24 shown in FIG. 4. In the embodiment of FIG. 5 the spools are behind the take up drums and thus are not visible in the figure. A spring 59 is connected between each storage drum 54 and take up drum 52 pair. This spring can be any of the springs described as suitable for use in the first embodiment and operates in the same manner. A lock mechanism (not shown) is connected to at least one of the storage drums. The lock mechanism operates in the same manner as the lock mechanism described in the embodiment of FIGS. 1, 2 and 3.

Figure 6:
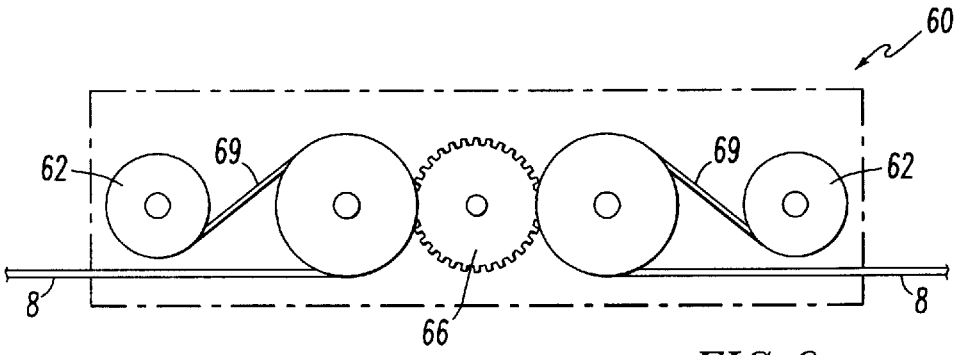
FIG. 6 is a front view of two interconnected spring motors that can be used in the cordless blind of the present invention.

Yet another spring motor configuration is shown in FIG. 6. The spring motor 60 has two take-up drums 62 each carrying a spring 69 that is also connected to an associated storage drum 64. This spring can be any of the springs described as suitable for use in the other embodiments and operates in the same manner. The two storage drums have gear teeth or an associated gear that meshes with gear 66. Thus, the two storage drums will turn simultaneously but in opposite directions. A lock mechanism (not shown) is connected to the gear 66 or to at least one of the storage drums. The lock mechanism operates in the same manner as the lock mechanism described in the embodiment of FIGS. 1, 2 and 3.

Figure 7:
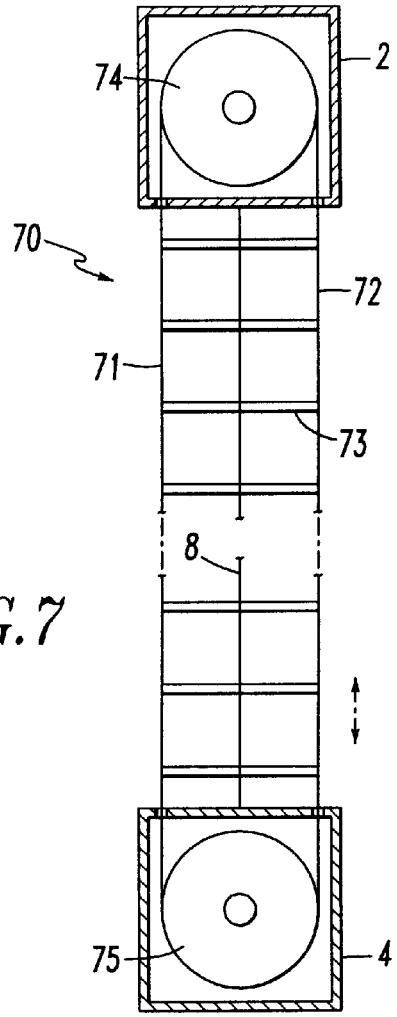
FIG. 7 is an end view of a ladder and associated pulleys that can be used when the cordless blind of the present invention is configured as a venetian blind.

In the event that the cordless blind is a venetian type blind I prefer to configure the ladders as shown in FIG. 7. Those ladders 70 have opposite rails 71, 72 having rungs between them that carry slats 73. The ends of the rails 71, 72 are connected together to form a loop. Pulleys 74 and 75 in the headrail 2 and the bottomrail 4 are positioned at either end of the loop and support the ladder. The slats can be tilted by pulling one of the ladder rails up or down as indicated by the double-headed arrow or a conventional tilt mechanism can be provided in the headrail.

Figure 8:
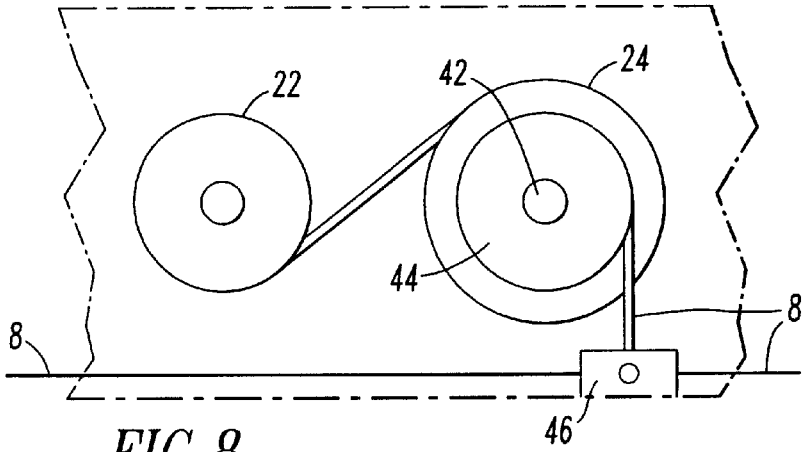
FIG. 8 is a front view of an alternative motor and lock mechanism for a second present preferred embodiment of my cordless blind.
Figure 9:
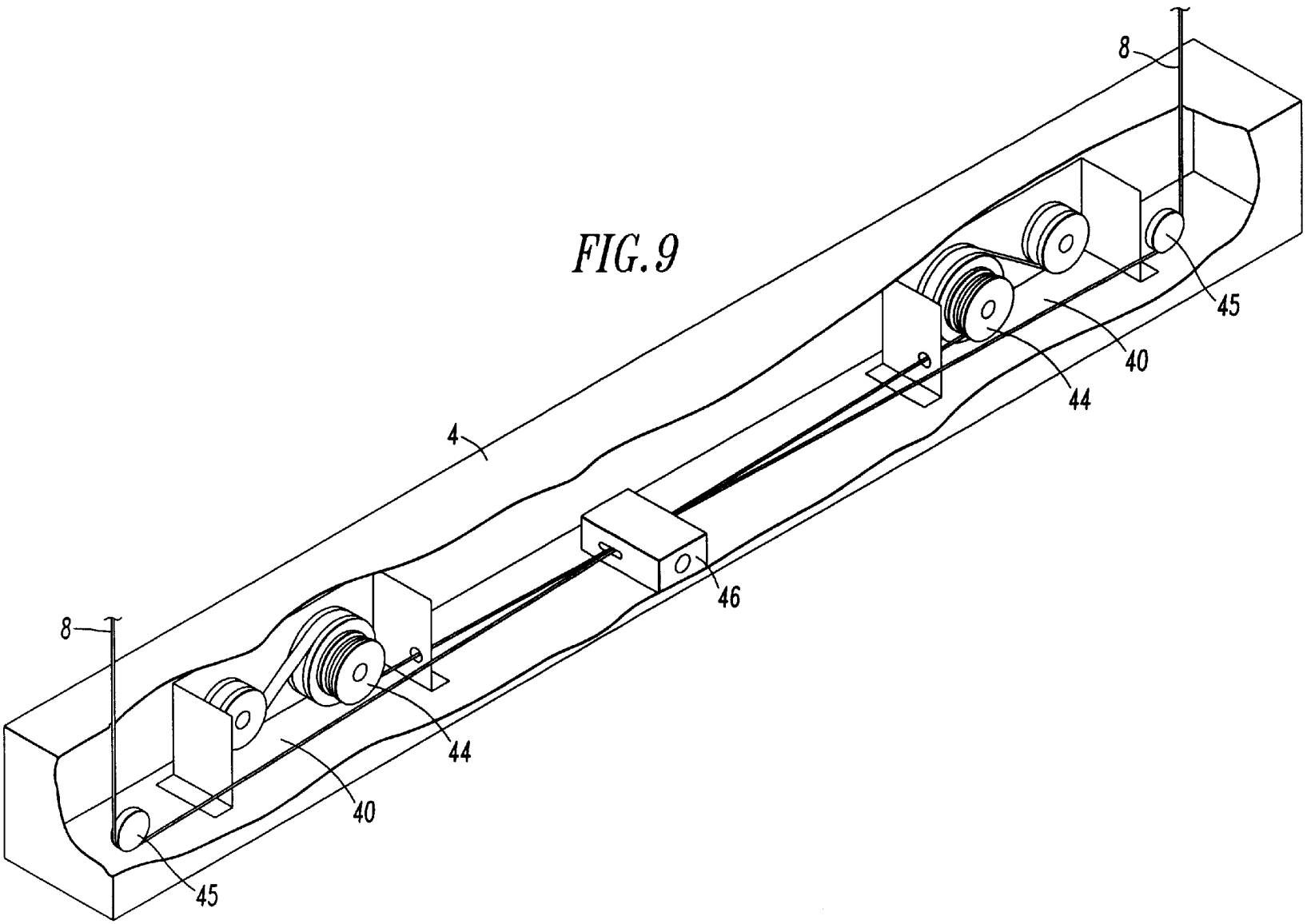
FIG. 9 is a perspective view of a bottomrail partially cut away to show for a third present preferred embodiment of my cordless blind.

Second and third present preferred embodiments of my cordless blind utilize a cord lock in conjunction with one or more spring motors. The spring motor and lock mechanism for the second embodiment shown in FIG. 8 has a single spring motor with a take up drum 24 and storage drum 22. A cord collector spool 44 is carried on the same axle 42 that carries take up drum 24. Consequently, the spring motor will try to wind the lift cords 8 onto the spool 24. The lift cords are routed through a cord lock 46. When the cord lock is in a locked position, the lift cords cannot be wound onto the spool. When the cord lock is unlocked the spring motor will wind the lift cords onto the spool raising the blind. Furthermore, while the cord lock is unlocked a user could pull the bottomrail down overcoming the force of the spring motor and lowering the blind. The cord lock could be biased to a locked position or could require manual operation to lock and unlock the cord lock. The third present preferred embodiment has a bottomrail illustrated in FIG. 9 containing two spring motors 40 similar to the motor shown in FIGS. 4 and 8. The lift cords 8 are routed through the bottomrail, over a pulley 45, through a cord lock 44 to a spool on the spring motor 40.

Figure 10:
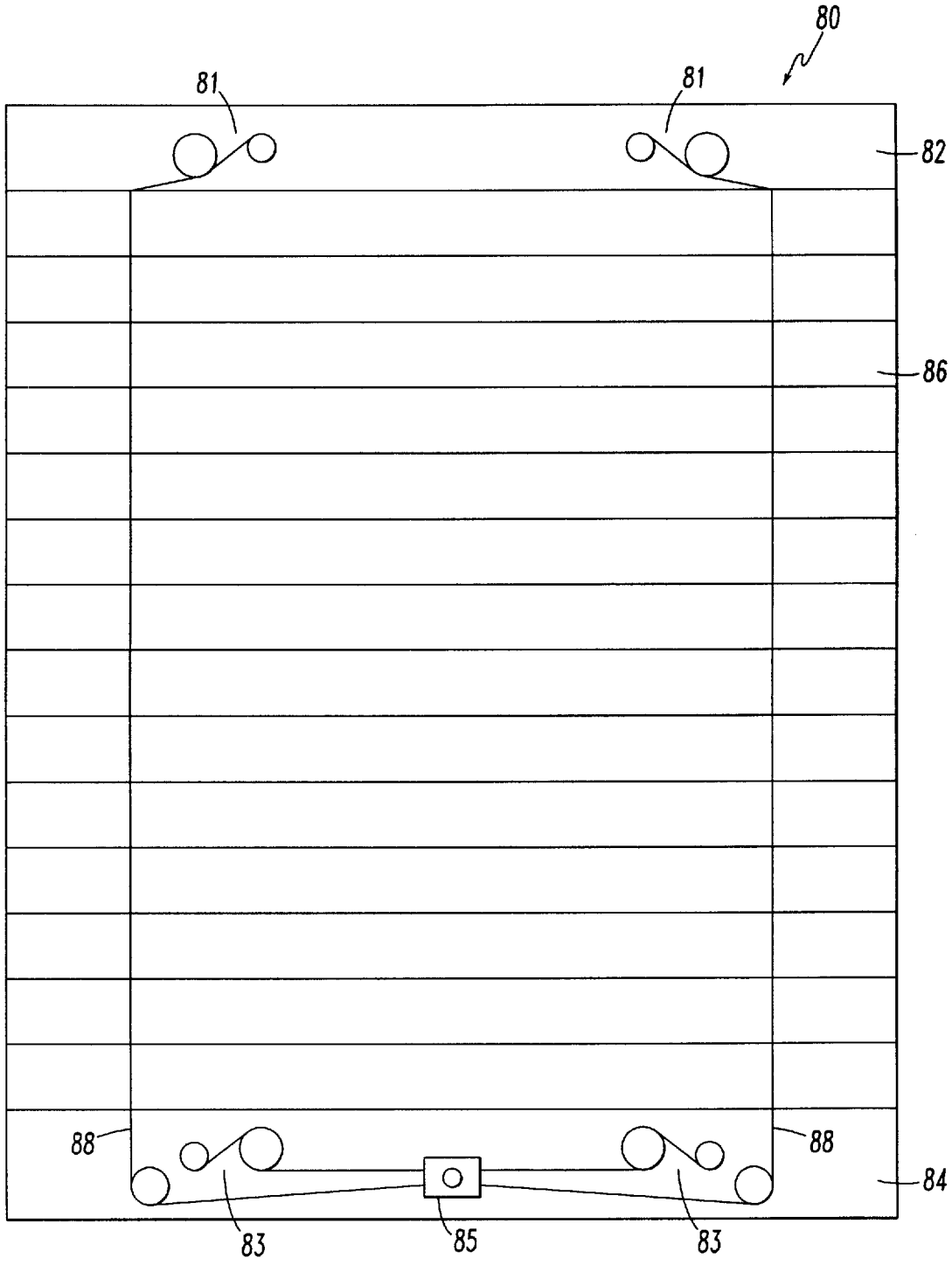
FIG. 10 is a schematic representation of a fourth present preferred embodiment of my cordless blind.

A fourth present preferred embodiment of my cordless blind is illustrated by the schematic of FIG. 10. That blind 80 has a headrail 82, bottomrail 84 and window covering material 86 connected between the headrail and bottomrail. Spring motors 81 and 83 are provided in both the headrail and the bottomrail. The spring motors 81 in the headrail are sized so as to be unable to lift the blind without the help of the spring motors 83 in the bottomrail 84. Lift cords 88 are connected to the spring motors 81 in the headrail as well as the spring motors in the bottomrail 84. The lift cords 88 pass through a cord lock 85 that operates like the cord lock in the embodiments of FIGS. 8 and 9.

It should be noted that in all of the embodiments the button that operates the lock mechanism is within the bottomrail. Consequently, no operator cords or wands are needed to operate the blind. The button is easily reached when the blind is partially lowered or in a finally lowered position.

While I prefer to provide a lock mechanism to control movement of the spring motors and the lift cords, a cordless blind could be made with the spring motors only in the bottomrail and without a lock mechanism by carefully choosing the spring motors to balance the bottomrail when the bottomrail is at selected positions such as would correspond to a fully open or half open blind. That cordless blind could have a cording arrangement of the types shown in FIGS. 2, 8 or 9 without the cord lock.

Although I have shown certain present preferred embodiments of my cordless blind it should be distinctly understood that the invention is not limited thereto, but may be variously embodied within the scope of the following claims.

I claim:

1. A cordless blind comprising:

a. a headrail;

b. a bottomrail;

c. a window covering material connected between the headrail and the bottomrail;

d. a first spool within the bottomrail;

e. a first lift cord having one end attached to the headrail and a second end attached to the first spool;

f. a first spring motor within the bottomrail and connected to the first spool in a manner to maintain tension on the first spool, such tension causing the first lift cord to be collected on the first spool and thereby raise the bottomrail when the first spool and first lift cord are free to move and no counteracting force is acting on the bottomrail;

g. a second spool within the bottomrail;

h. a second lift cord having one end attached to the headrail and a second end attached to the second spool;

i. a second spring motor within the bottomrail and connected to the second spool in a manner to maintain tension on the second spool, such tension causing the second lift cord to be collected on the second spool and thereby raise the bottomrail when the second spool and second lift cord are free to move and no counteracting force is acting on the bottomrail; and j. a cord lock mechanism within the bottomrail and directly attached to the first lift cord and the second lift cord, the cord lock mechanism having a locked position wherein the first and second lift cords are restrained from being collected on the first and second spools and an unlocked position that allows the first and second lift cords to move freely, the cord lock mechanism being biased toward a locked position.

2. The cordless blind of claim 1 wherein the window covering material is selected from the group consisting of pleated fabric, pleated film, cellular fabric and cellular films.

3. The cordless blind of claim 1 wherein the window covering material is comprised of a plurality of ladders carrying slats.

4. The cordless blind of claim 3 also comprising a tilt mechanism attached to the ladders.

5. The cordless blind of claim 4 wherein the ladders have rungs connected to form a continuous loop and the tilt mechanism comprises a first pulley in the headrail and a second pulley in the bottomrail for each ladder and the rails of each ladder pass over the first pulley and the second pulley for that ladder.

6. The cordless blind of claim 5 wherein the first pulleys for all the ladders are on a common axle.

7. The cordless blind of claim 5 wherein the second pulleys for all the ladders are on a common axle.

8. The cordless blind of claim 1 wherein the window covering material is fabric configured as a roman shade.

9. The cordless blind of claim 1 wherein the lock mechanism is a cord lock.

* * * * *